United States Patent [19]

Trifunovic et al.

[11] 3,999,262

[45] Dec. 28, 1976

[54] APPARATUS FOR TEXTURING CONTINUOUS FILAMENT YARN

[75] Inventors: Alexander L. Trifunovic, Wilmington, Del.; William H. Hills, Melbourne; Milton H. Borgman, Satellite Beach, both of Fla.; Emory P. Mersereau, Wilmington, Del.

[73] Assignee: Indian Head Inc., New York, N.Y.

[22] Filed: Mar. 26, 1975

[21] Appl. No.: 562,188

Related U.S. Application Data

[62] Division of Ser. No. 475,123, May 31, 1974.

[52] U.S. Cl. ..... 28/1.6

[51] Int. Cl.[2] ..... D02G 1/12

[58] Field of Search ..... 28/1.3, 1.6, 1.7, 72.11, 28/72.14

[56] References Cited

UNITED STATES PATENTS

| | | | |
|---|---|---|---|
| 2,914,835 | 12/1959 | Slayter et al. | 28/72.11 X |
| 3,160,923 | 12/1964 | Rainard et al. | 28/1.6 |
| 3,707,299 | 12/1972 | Trifunovic | 28/1.6 |
| 3,798,718 | 3/1974 | Trifunovic | 28/72.14 X |
| 3,894,319 | 7/1975 | Trifunovic | 28/1.6 |

*Primary Examiner*—Louis K. Rimrodt

[57] ABSTRACT

A method and apparatus for texturing continuous filament yarn wherein the yarn is fed at a controlled rate and under controlled tension by a pair of feed rolls into a confined crimping zone against a mass of crimped yarn therein, causing the yarn to collapse longitudinally to form crimps which become part of such mass. Heat and pressure are applied to the yarn mass in the crimping zone to plastically deform the yarn and partially set the crimps. The crimped yarn mass is then fed at a controlled rate by means of toothed rolls from the crimping zone into a setting zone. Heat and pressure are applied to the yarn mass in the setting zone to fully set the crimps. The yarn mass is moved through the setting zone by an endless belt having upstanding teeth that positively engage the yarn mass. The pressure applied to the yarn mass in the setting zone is substantially sufficient only to keep the crimps closed during the final setting thereof. The crimped yarn mass is then fed from the setting zone into a cooling zone. The yarn mass is cooled in the cooling zone to a temperature below that at which the yarn undergoes any molecular structural alteration in the absence of the application of a substantial force thereto. Finally, the yarn is withdrawn at a controlled rate from the cooling zone in continuous filament form. One of the feed rolls is mounted on one end of a yoke, the other end of which has an eccentric mounting shaft, the movement of which allows the feed rolls to be perfectly aligned in skewness and parallelism. Proper alignment of the crimping and setting chamber with respect to the other elements is accomplished by providing the frame with a number of alignment shoulders against which the chamber is set upon installation.

19 Claims, 33 Drawing Figures

FIG. 6
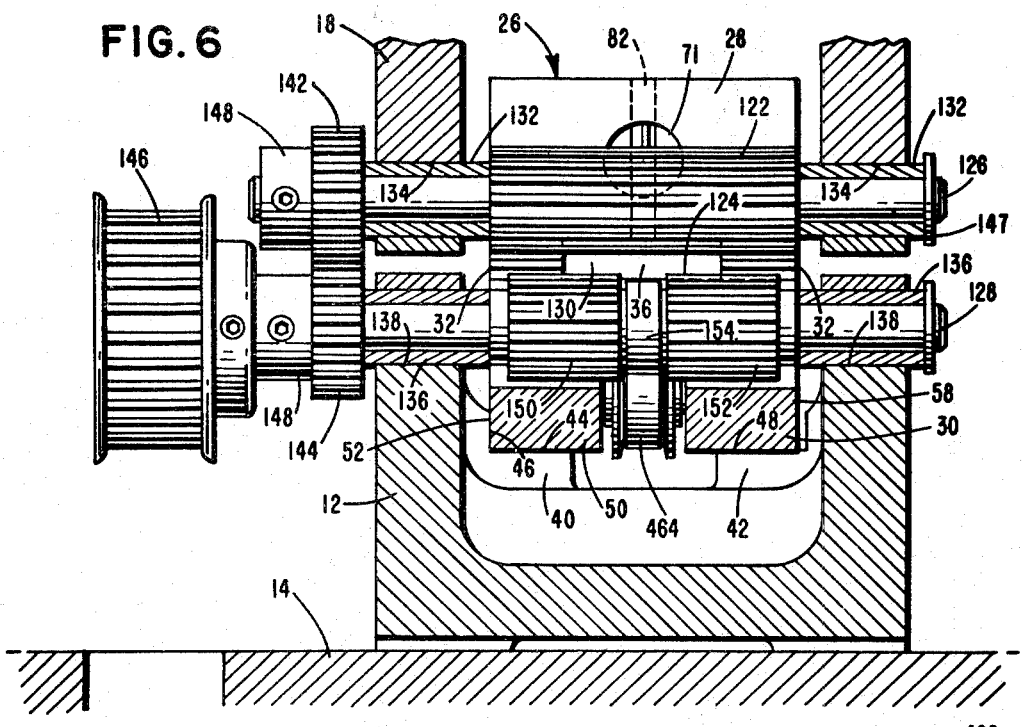
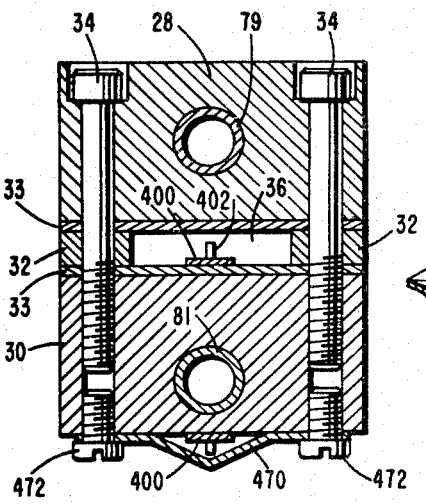
FIG. 14
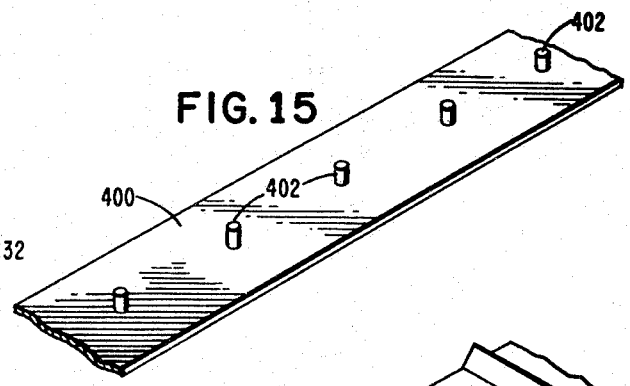
FIG. 15
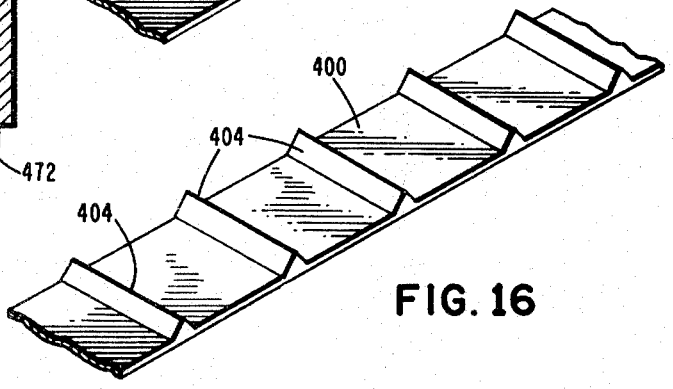
FIG. 16

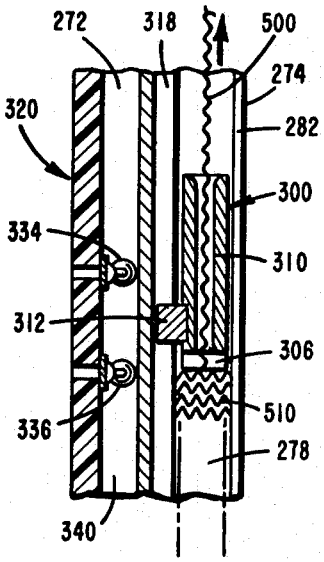
FIG. 20
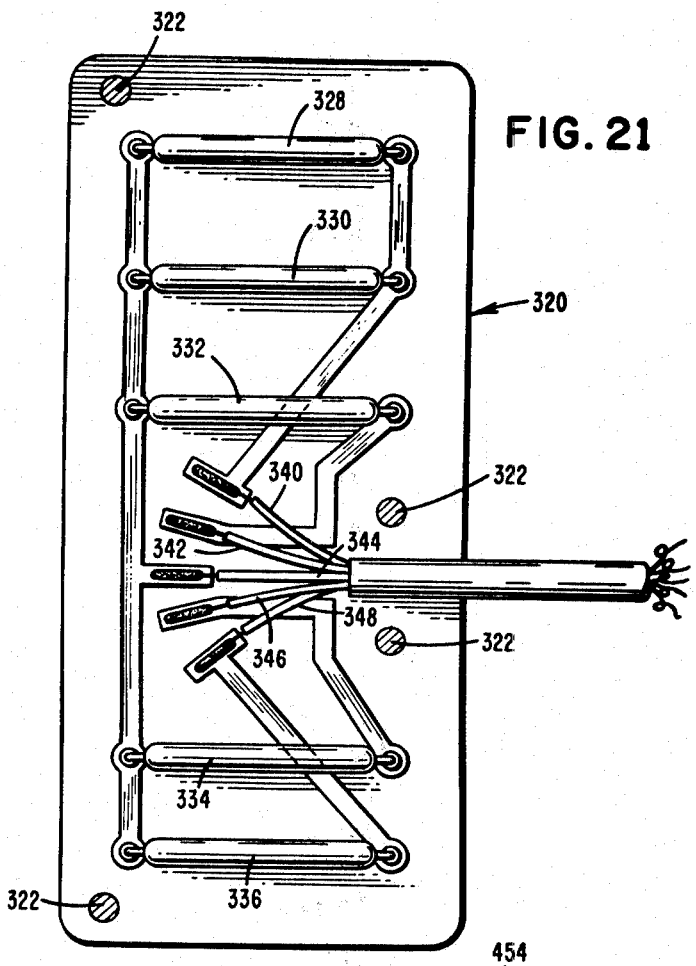
FIG. 21
FIG. 22
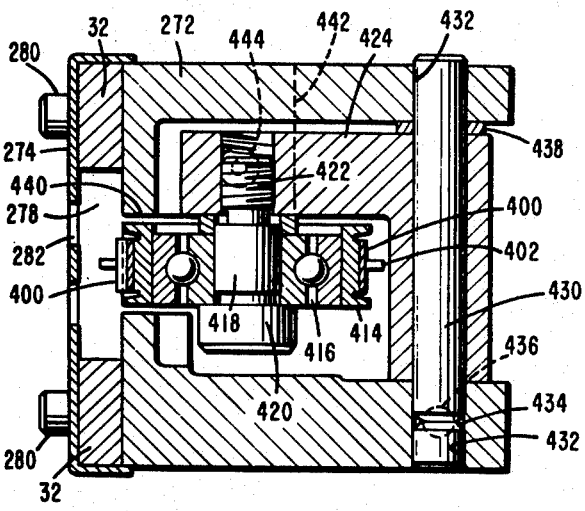
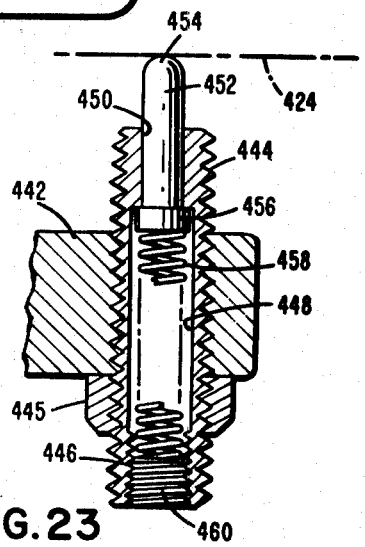
FIG. 23

APPARATUS FOR TEXTURING CONTINUOUS FILAMENT YARN

This application is a division of application Ser. No. 475,123, filed May 31, 1974.

BACKGROUND OF THE INVENTION

1. Field of the Invention

The present invention relates to methods and apparatus for texturing continuous filament yarn, and in particular to a method and apparatus which is efficacious for crimping continuous filament polyester yarn.

2. Description of the Prior Art

Several methods of texturing continuous filament polyester yarn presently are known. The methods which have achieved the widest commercial success are those in which the yarn is textured by imparting an artificial or false twist thereto. The quality and uniformity of the textured yarn product produced by such methods vary widely, and production rates are limited to the texturing of approximately 200 yards per minute at each texturing station.

The texturing of continuous filament yarns by imparting longitudinal crimps thereto also has been widely adopted for yarns other than polyester yarn, and particularly for texturing nylon yarn. However, the prior art methods of crimping continuous filament yarns and in particular those using a stuffer crimper apparatus largely have been unsuccessful for crimping polyester yarn. This failure results primarily from the different characteristics inherent in nylon and polyester yarns. In the stuffer crimping methods presently used commercially for crimping nylon yarn, a mass of crimped yarn in the form of a crimped yarn core is fed under pressure through a relatively long crimping tube in which significant frictional forces are developed between the outer surface of the core and the walls of the tube. Nylon yarn, due to its particular characteristics, moves at a substantially uniform rate through the crimping tube, even when subjected to these substantial frictional forces. However, polyester yarn does not so react under similar conditions, but tends to move in spurts, resulting in undesirable variations in the characteristics of the crimped yarn.

SUMMARY OF THE INVENTION

The method and apparatus of the present invention obviate the difficulties associated with use of the prior art stuffer crimper methods and apparatus for crimping polyester yarn, and may be used advantageously for crimping other continuous filament yarns, such as nylon yarn.

The basic method of the invention comprises: feeding continuous filament yarn at a controlled rate and under controlled tension into a confined crimping zone against a mass of crimped yarn therein causing the yarn to collapse longitudinally and fold over forming crimps which become part of the mass; applying heat and pressure to the mass in the crimping zone to plastically deform the yarn and partially set the crimps; feeding the mass at a controlled rate from the crimping zone to a setting zone; transporting the yarn mass at a controlled rate through the setting zone; applying heat and pressure to the mass in the setting zone to fully set the crimps; feeding the yarn mass at a controlled rate from the setting zone to a cooling zone after the crimps have been fully set; cooling the mass in the cooling zone to a temperature below the temperature at which the yarn undergoes any molecular structural alteration in the absence of the application of a substantial force thereto; and withdrawing the yarn at a controlled rate in continuous filament form from the cooling zone.

Basically described, the apparatus of the invention is a stuffer crimper comprising: a housing; a crimping chamber secured to the housing and having a channel extending therethrough; means for heating the chamber; a pair of opposed feed rolls rotatably mounted on the housing adjacent one end of the chamber for feeding yarn into the chamber channel; at least one crimp control roll rotatably mounted on the housing and extending into the chamber channel, the portion of the channel between the feed rolls and the crimp control roll defining a confined crimping zone, whereby continuous filament yarn is fed into the crimping zone by the feed rolls against a mass of crimped yarn therein in the form of a core of crimped yarn causing the yarn to collapse longitudinally and fold over forming crimps which become part of the core, the crimp control roll being spaced from the feed rolls along the channel a distance no greater than the distance required for the yarn to be plastically deformed and the crimps partially set in the crimping zone, the portion of the channel between the crimp control roll and the end of the chamber opposite the feed rolls defining a setting zone, whereby the core is fed into the setting zone by the crimp control roll and the crimps are fully set therein: a setting zone comprising a heating portion and a cooling portion; means for rotatably driving the pair of feed rolls at the same rotational velocity; means for rotatably driving the crimp control roll independently of the feed rolls, whereby the pressure on the crimped yarn core in the crimping zone may be controlled by regulating the relative rotational velocities of the feed rolls and the crimp control roll; a yarn core transport belt extending from the crimp control roll along the length of the heating portion of the setting zone into the cooling portion thereof and having upstanding teeth extending into the channel to engage the yarn mass therein; and means for driving the transport belt independently of the feed rolls to transport the yarn mass through the setting zone at a predetermined rate.

Generally, the leg length of the crimps, and therefore the bulk of the crimped yarn, is controlled by regulating the pressure applied to the crimped yarn core in the crimping zone, although other parameters, such as heat and time of residence in the crimping zone, also affect the characteristics of the crimped yarn.

The pressure applied to the crimped yarn core is a function of the relative rotational velocities of the feed rolls and the crimp control roll. Moreover, it has been found that such pressure also is a function of the rate at which the crimped yarn core moves through the crimping zone. Generally, as the rate at which the core moves through the crimping zone is increased for a particular ratio of feed roll velocity to crimp control roll velocity, the pressure applied to the core decreases and therefore the bulk of the crimped yarn also decreases.

In both the crimping and setting zones, the crimped yarn core is heated to a temperature below the liquefaction temperature of the yarn. The time of residence of the core in the crimping zone is substantially less than the time of residence of the core in the setting and cooling zones, and in the latter two zones the frictional forces applied to the core are minimized.

Due to the heat and pressure applied to the yarn mass during the process, it is common for deposits to form on the walls of the chamber. For example, some yarns are coated with a film of oil or a powder applied as a lubricant during their manufacture, and this lubricant sublimates during the setting of the yarn to form a sludge deposit on the walls of the setting chamber. These deposits greatly increase the friction between the chamber walls and the yarn mass, inhibiting the movement of the yarn mass through the setting zone. The amount of this resistance at any given moment is not predictable. It can cause the yarn mass to move in spurts, establishing pockets of differing yarn density during the critical setting operation, thus varying the yarn crimp characteristics and impairing the uniformity of the finished yarn product. It tends to cause the yarn to tear-drop as it moves through the setting zone, that is, the peripheral portion of the yarn mass lags behind the center portion, thus disturbing the crimp characteristics. The resistance caused by these deposits can rise to such a level as to totally stall the movement of the yarn mass, thus jamming the apparatus and rendering it inoperative. Also, the sludge can become abrasive and damage the yarn as it passes through the setting zone.

In the preferred embodiment of the apparatus of the invention, the channel in the crimping chamber has a substantially rectangular transverse cross-section. Desirably, the cross-sectional width of the channel should be as small as possible, Ideally, it should be approximately equal to the diameter of the yarn. However, both structural and operational factors limit the minimum cross-sectional width of the channel. For example, for wearing apparel yarn, i.e., 40–150 denier, the cross-sectional width of the channel must be at least approximately 0.10 inch.

The preferred embodiment of the apparatus also includes means for feeding yarn into the nip between the feed rolls with a traversing motion axially of the feed rolls under controlled tension, and means for controlling the relative feed and withdrawal rates of yarn into and from the crimper. Furthermore, the preferred embodiment of the apparatus includes means for engaging the mass of crimped yarn at the exit of the crimping zone and transporting the mass of crimped yarn through the setting zone.

Also, in the preferred embodiment of the apparatus, a relatively short portion of the channel in the crimping chamber adjacent the feed rolls has a substantially elliptical transverse cross-section. This feature in combination with the traversing yarn feed to the feed rolls results in the formation of a uniformily crimped yarn core in the crimping zone.

The preferred embodiment of the apparatus further includes a slug which rides freely on the top of yarn core in the cooling zone. This slug has a channel therethrough through which the yarn is withdrawn in continuous filament form from the cooling zone. The slug also has a particular external configuration which facilitates withdrawal of the yarn in a substantially slub-free condition.

In order to facilitate the proper alignment of the crimping chamber with the other elements of the apparatus, in the preferred embodiment the crimping chamber is made as a removable unit, and a plurality of alignment shoulders and surfaces are provided on the machine frame to receive the crimping chamber unit and position the unit accurately.

Finally, the preferred embodiment of the apparatus includes an eccentric mounting for the pivotable yoke that holds one of the feed rolls, to allow compensation to be made for feedroll skewness and parallelism.

With the foregoing in mind, it is an object of the present invention to provide an improved method and apparatus for texturing continuous filament yarn, and particularly polyester yarn.

It is a further object of the invention to provide an improved method and apparatus for texturing continuous filament yarn by crimping such yarn.

It is also an object of the invention to provide an improved method and apparatus for crimping continuous filament yarn which achieve a high degree of crimp uniformity and which are operable at yarn feed speeds of approximately 1,000 yards per minute per crimping station.

It is an additional object of the invention to provide a method and apparatus for crimping continuous filament yarn in which a high degree of control may be exercised over the bulk of the crimped yarn product produced.

These and other objects of the invention will become apparent upon a consideration of the detailed description of the preferred embodiment of the method and apparatus thereof in connection with the following drawings, wherein like reference numerals identify like elements throughout.

BRIEF DESCRIPTION OF THE DRAWINGS

FIG. 6 is a sectional view taken on line 6—6 of FIG. 3A;

FIG. 14 is a sectional view taken on line 14—14 of FIG. 13;

FIG. 15 is a perspective view of one type of yarn core transport belt that can be employed in the apparatus shown in FIG. 1;

FIG. 16 is a perspective view of an alternate type of yarn core transport belt that can be employed in the apparatus shown in FIG. 1;

FIG. 20 is a sectional view taken on line 20—20 of FIG. 18;

FIG. 21 is a plan view of the electrical circuitry of the yarn core height sensing and control means of the apparatus shown in FIG. 1;

FIG. 22 is a sectional view taken on line 22—22 of FIG. 3B;

FIG. 23 is a sectional view taken on line 23—23 of FIG. 17;

DESCRIPTION OF A PREFERRED EMBODIMENT

Figure 1:
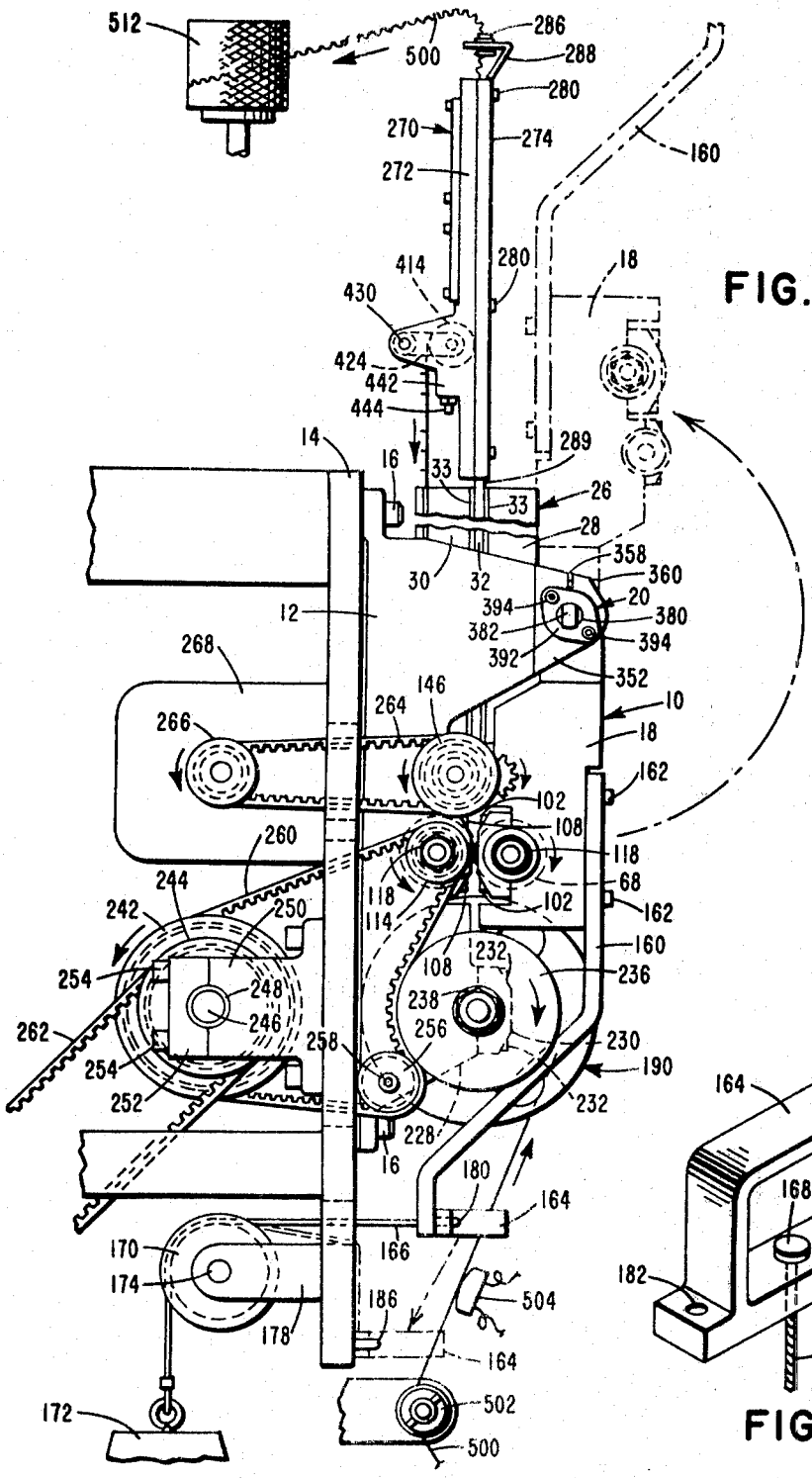
FIG. 1 is a side elevational view of a preferred embodiment of the stuffer crimper apparatus of the invention.

A preferred embodiment of the apparatus of the invention is a stuffer crimper designated generally by reference numeral 10. Crimper 10 includes a rear stationary housing member 12 which is secured to a frame 14 by bolts 16, or other suitable fasteners. A front housing member 18 is pivotally connected to rear housing member 12 by an eccentric mounting indicated generally as 20 and explained in detail below.

Figure 9:
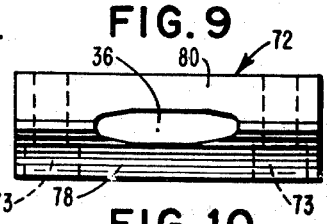
FIG. 9 is a top plan view of the feed roll saddle taken on line 9—9 of FIG. 8.
Figure 10:
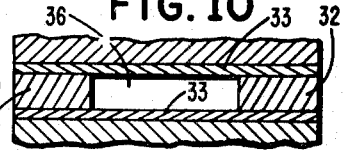
FIG. 10 is a sectional view taken on line 10—10 of FIG. 7.
Figure 3B:
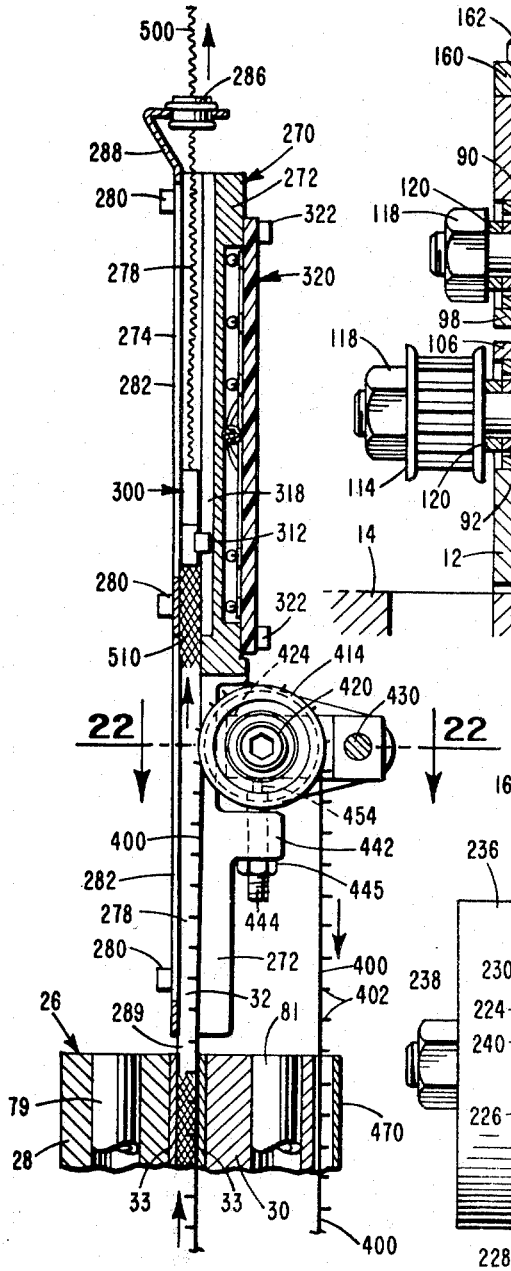
FIG. 3B is a longitudinal sectional view of the upper portion of the apparatus shown in FIG. 1.
Figure 12:
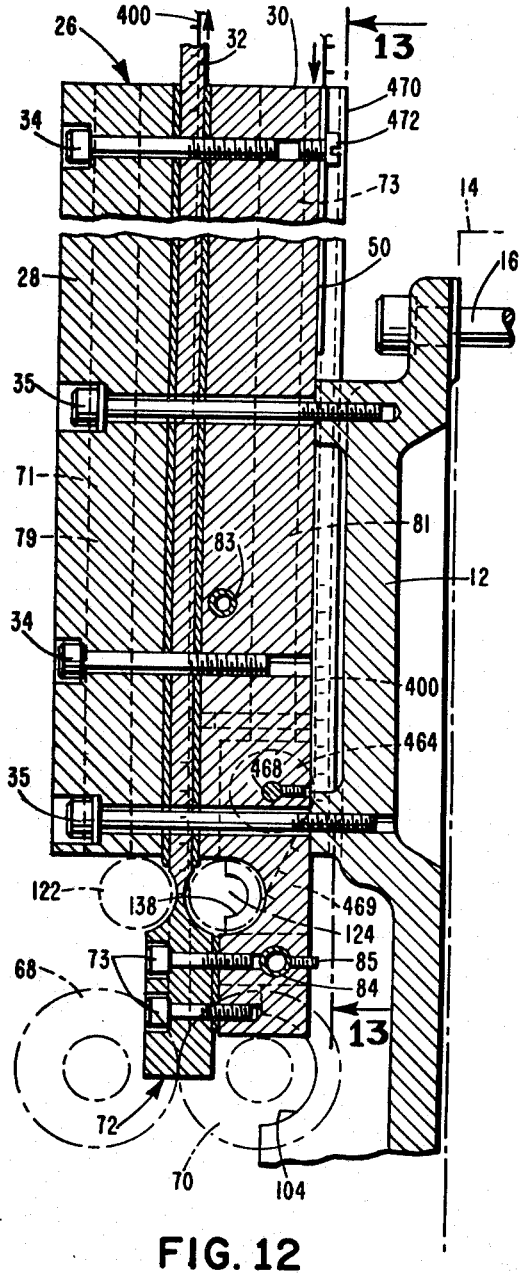
FIG. 12 is a sectional view taken on line 12—12 of FIG. 11.
Figure 13:
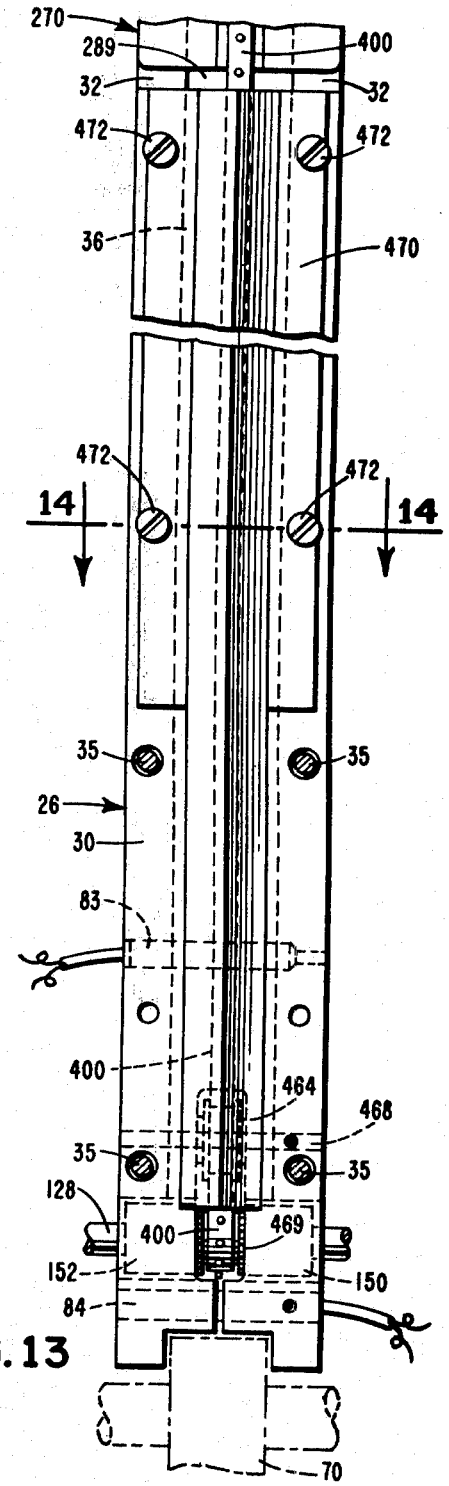
FIG. 13 is a rear elevational view of a portion of the apparatus shown in FIG. 1, taken along line 13—13 of FIG. 12.
Figure 17:
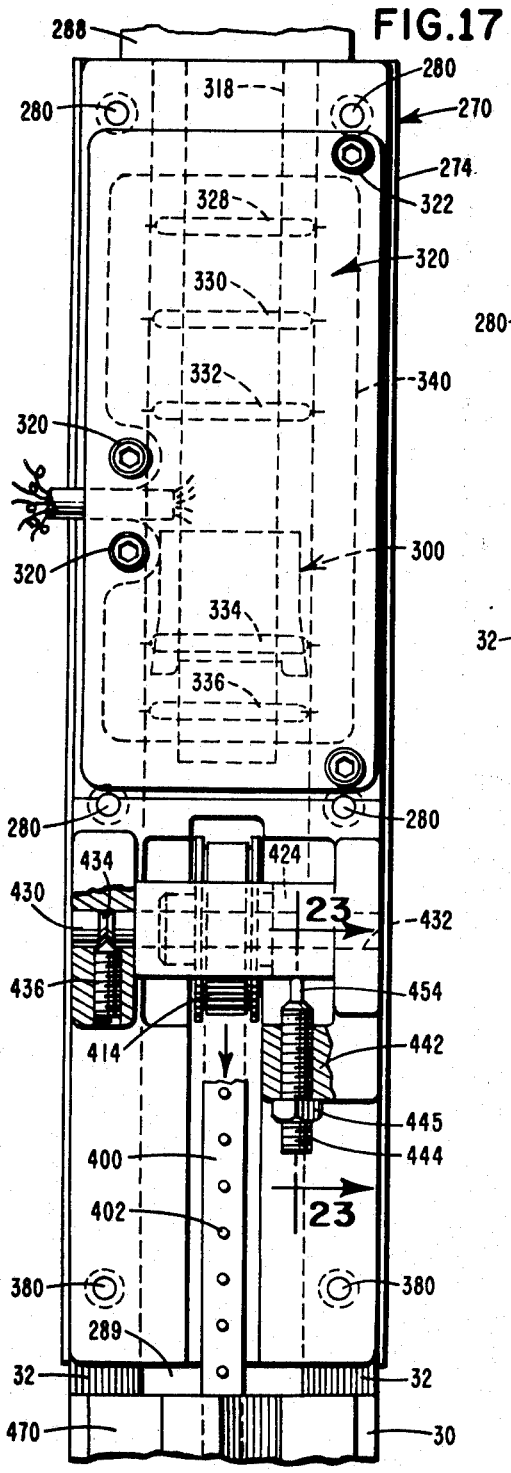
FIG. 17 is a rear elevational view of the upper portion of the apparatus shown in FIG. 1.
Figure 18:
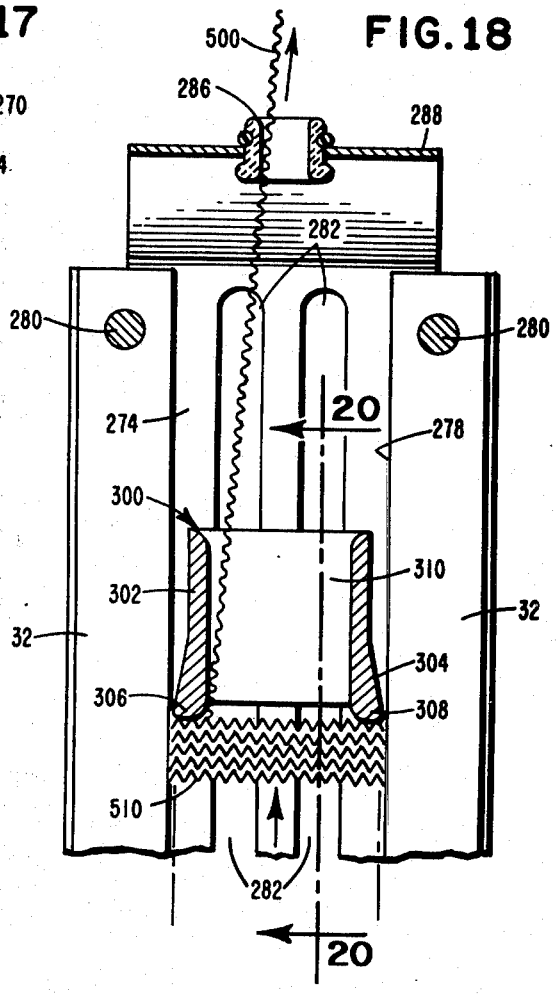
FIG. 18 is a sectional view of a portion of the apparatus shown in FIG. 17.

Mounted between housing members 12 and 18 is a crimping chamber 26 comprising front and rear longitudinally mated halves 28 and 30, respectively (FIGS. 3A and 12) and a pair of laterally spaced bars 32 interposed therebetween. Bars 32 extend upwardly the full length of the apparatus. Chamber halves 28 and 30 are made from a metallic material, and are secured together by a plurality of bolts 34. Bars 32 are made from a metallic material having a relatively low heat conductivity, such as 302 stainless steel, so that the heat from the crimping and setting zones is not transmitted by bars 32 into the cooling zone. Assembled chamber 26 is secured to rear housing member 12 by a plurality of bolts 35, or other suitable fasteners. Bolts 35 are inserted through openings 37 in chamber halves 28 and 30 (FIG. 12) which have a slightly larger diameter than the bolts so that chamber 26 is slightly movable and can be properly aligned with the other elements, as explained below. Chamber halves 28 and 30 and bars 32 define respectively the front, back and sides of substantially the entire length of a channel 36. Friction reducing inserts 33 are provided to line the front and rear of channel 36. A short portion of channel 36 at the lower end thereof has a generally elliptical transverse cross-section not defined by bars 32, (FIG. 9) and the remaining portion of the channel has a substantially rectangular transverse cross section (FIG. 10).

Alignment of crimping chamber 26 with respect to the other components of the apparatus is critical. To facilitate this alignment, rear housing member 12 is provided with first and second sets of bosses 40 and 42. Each boss 40 has a rear alignment surface 44 and a side alignment surface 46. Each boss 42 has a rear alignment surface 48. The rear surface 50 and the side surface 52 of chamber half 30 are smoothly and accurately machined, as are surfaces 42, 46 and 48. To install chamber 26 upon rear housing 12, surface 50 is placed into contact with alignment surface 44, and surface 52 in contact with side alignment surface 46. Screws 35 are installed but not tightened. Chamber 26 is then moved longitudinally until its proper relationship with the other components is achieved. Then chamber 26 is locked against lateral movement by tightening down upon it a pair of locking screws 56 threaded through rear housing 12 and contacting side surface 58 of chamber 26, which forces chamber alignment surface 52 to seat against side alignment surfaces 46. Screws 35 are then tightened, seating rear surface 50 against rear alignment surfaces 44 and 48.

Figure 3A:
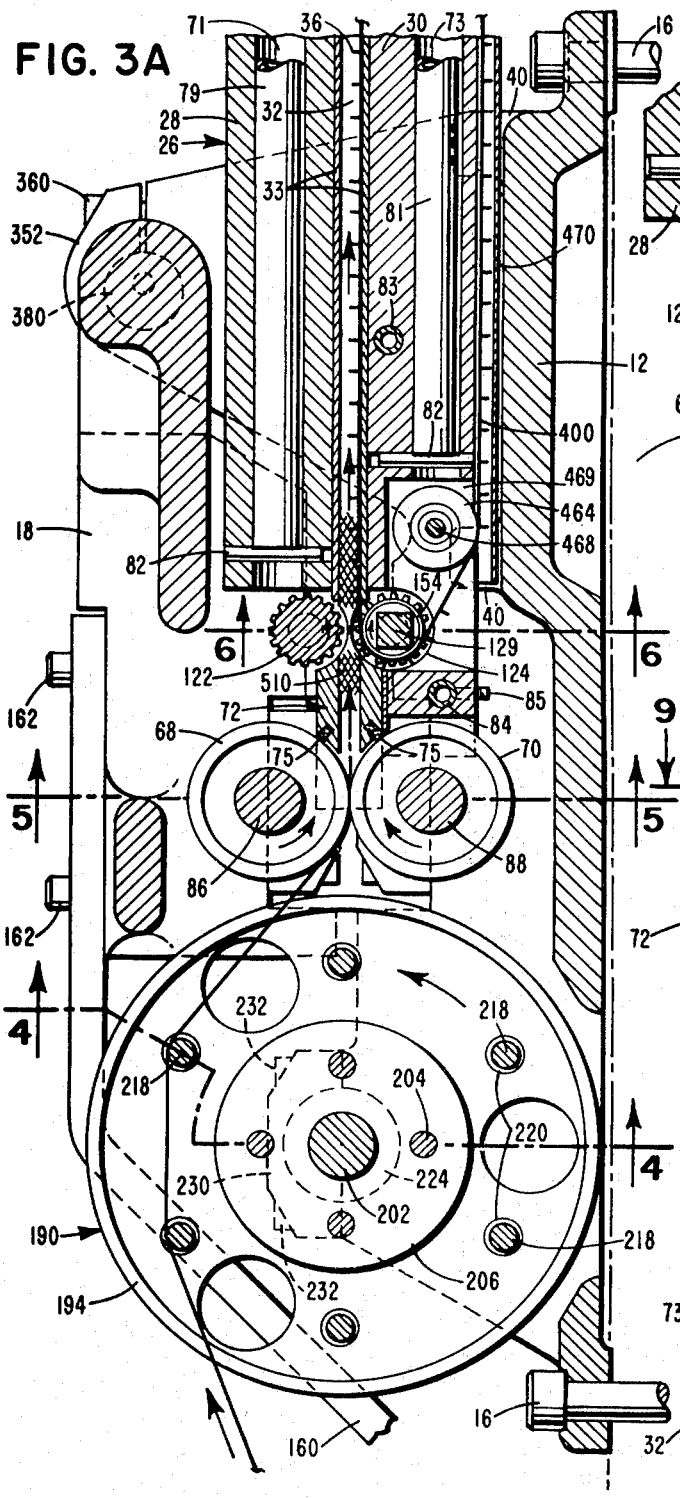
FIG. 3A is a longitudinal sectional view of the lower portion of the apparatus shown in FIG. 1.
Figure 7:
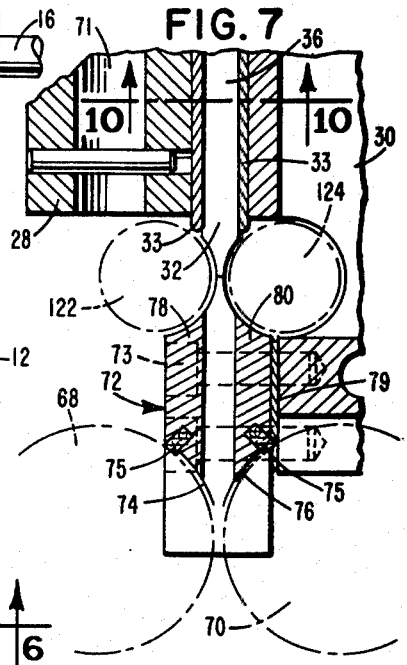
FIG. 7 is a longitudinal sectional view of crimping zone portion of the apparatus shown in FIG. 3A.
Figure 8:
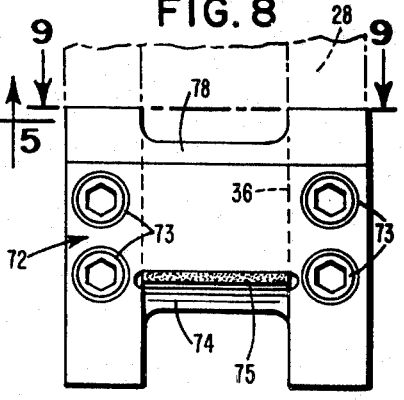
FIG. 8 is a front elevational view of a portion of the feed roll saddle of the apparatus shown in FIG. 7.

A pair of opposed feed rolls 68 and 70 are journalled in housing members 18 and 12, respectively, adjacent the lower end of chamber 26. In their operating positions, feed rolls 68 and 70 define a nip between. Positioned at the lower end of chamber 26 is a saddle 72, which fits closely about the peripheries of feed rolls 68 and 70, from slightly below to slightly above the nip (FIG. 3A). Saddle 72 is attached to rear chamber half 30 by bolts 73. A first pair of arcuate surfaces 74 and 76 of saddle 72 fit closely about the circumferential peripheries of rolls 68 and 70. A second set of arcuate surfaces 78 and 80 of saddle 72 fit closely about the axial peripheries of a pair of crimp control rolls 122 and 124. A shim 79 can be interposed between saddle 72 and chamber half 30, if necessary. A felt pad 75 (FIG. 3A) is mounted at the upper end of each of arcuate surfaces 74 and 76 and extends outwardly therefrom into contact with the associated rolls 68 and 70, so that yarn cannot migrate outwardly between the arcuate surfaces and the feed rolls.

Chamber halves 26 and 28 are provided with a pair of elongated bores 71 and 73, respectively, into which are inserted a pair of electrical heating elements 79 and 81. Bores 71 and 73 are parallel to channel 36, and are closed at their lower ends by pins 82, upon which rest heating elements 79 and 81. A temperature sensing element 83 is positioned in the lower portion of chamber half 30 to sample the temperature in the chamber. Another heating element 84 can be installed in a bore in the lower portion of chamber half 30, held in place by a set screw 85.

Figure 5:
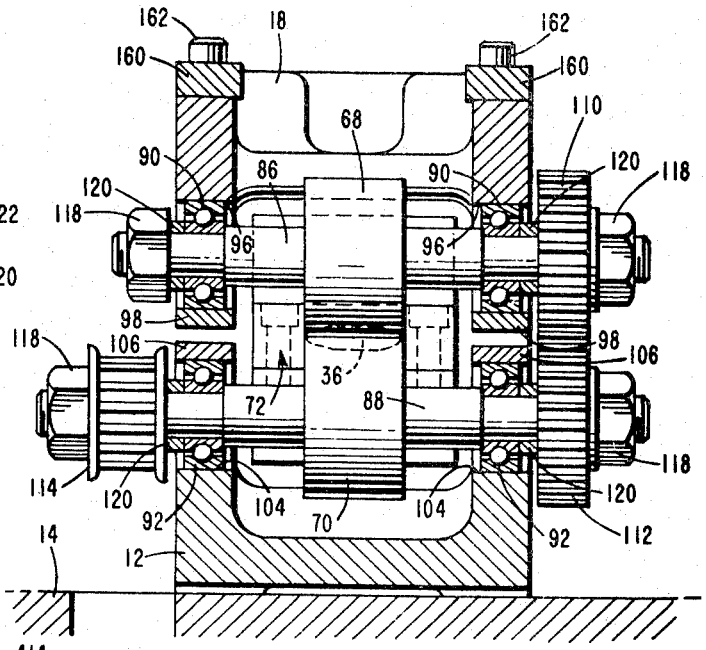
FIG. 5 is a sectional view taken on line 5—5 of FIG. 3A.

Feed rolls 68 and 70 are machined as integral portions of shafts 86 and 88 (FIG. 5). Shaft 86 is journalled in bearings 90 mounted in front housing member 18, and shaft 88 is journalled in bearings 92 mounted in rear housing member 12. The outer races of bearings 90 are accommodated in recesses 96 machined in front housing member 18. Bearings 90 are locked in position by bearing retainers 98, which are secured to housing member 18 by bolts 102 (FIG. 1). Similarly, the outer races of bearings 92 are accommodated in recesses 104 formed in rear housing member 12, and are locked in position therein by bearing retainers 106. Retainers 106 are secured to housing member 12 by bolts 108 (FIG. 1).

A gear 110 is affixed to one end of shaft 86 and a similar gear 112 is affixed to the same end of shaft 88. A pulley 114 is affixed to the other end of shaft 88. The ends of shafts 86 and 88 are threaded and the shafts are axially locked in position with respect to bearings 90 and 92 by nuts 118 and spacers 120.

A pair of opposed crimp control rolls 122 and 124 also are journalled in housing members 18 and 12, respectively, about axes parallel to the axes of feed rolls 68 and 70. In the preferred embodiment of the apparatus of the invention, crimp control roll portions of roll 122 and 124 have textured surfaces formed by gear-like teeth. Roll 122 is machined as an integral portion of shaft 126 (FIG. 6). Crimp control rolls 122 and 124 are accommodated within arcuate openings machined in chamber halves 28 and 30, respectively. The peripheries of crimp control rolls 122 and 124 are spaced apart, but protrude into channel 36, to define a yarn control passage of fixed width designated by reference numeral 130. Shaft 126 is journalled in bushings 132 which are accommodated in recesses 134 machined in front housing member 18. Similarly, shaft 128 is journalled in bushings 136 which are accommodated in recess 138 machined in rear housing member 12.

A gear 142 is affixed to one end of shaft 126 and a similar gear 144 is affixed to the same end of the shaft 128 (FIG. 6). A pulley 146 is affixed to the same end of shaft 128 as gear 144, outwardly of the gear. Shaft 126 and 128 are axially locked in position with respect to bushings 132 and 136 by spring clips 147 and clamps 148.

Crimp control roll 122 is continuous across the entire width of channel 36. However, crimp control roll 124 is split into a pair of toothed sections 150 and 152 flanking a central yarn transport belt pulley section 154. Gear sectons 150 and 152 and pulley 154 are mounted on a shaft 128 which has a square section at its mid-portion as at 129.

When front housing member 18 is in the operating position shown in solid lines in FIG. 1, gear 110 meshes with gear 112 and gear 142 meshes with gear 144. Also, the circumferential periphery of feed roll 68 contacts the circumferential periphery of feed roll 70, forming a nip therebetween. The teeth of gears 110, 112, 142 and 144 are elongated sufficiently to insure that the gears will mesh properly when the feed rolls are in contact with each other.

Crimper 10 also includes means for urging front housing member 18 rearward toward rear housing member 12. Such means include a split frame 160 (FIGS. 1 and 2) which is affixed to front housing member 18 by bolts 162, or other suitable fasteners. Frame 160 extends downwardly and inwardly from the lower end of housing member 18. A handle 164 (FIG. 1A) is removably connected to the lower end thereof.

Figure 1A:
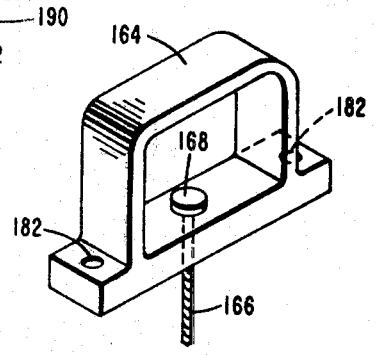
FIG. 1A is a perspective view of a detail of the apparatus shown in FIG. 1.
Figure 2:
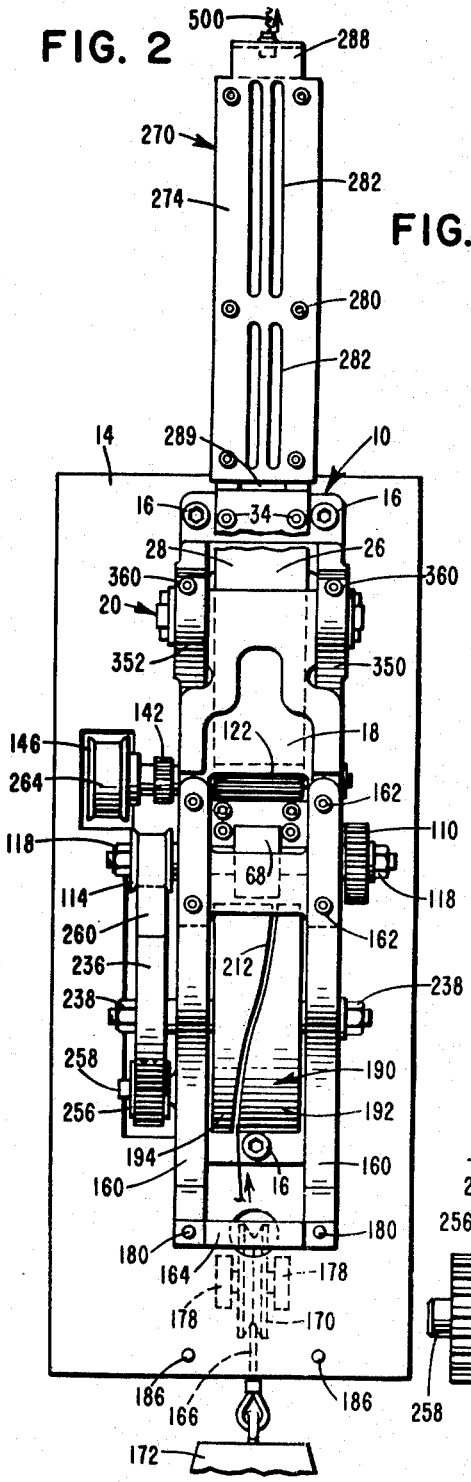
FIG. 2 is a front elevational view of the apparatus shown in FIG. 1.

A flexible cable 166 extends through the back of handle 164 and is slidably connected thereto by a disc 168 fixed to the end of the cable (FIG. 1A). Cable 166 passes around a pulley 170 and a weight 172 is affixed to the other end thereof. Pulley 170 is mounted on a shaft 174 which is journalled in a pair of arms 178 mounted on frame 14.

Affixed to the lower end of the frame 160 are a pair of horizontally aligned pins 180 which are adapted to register with a pair of openings 186 in the back of handle 164. When pins 180 are engaged with openings 182, weight 172, via cable 166, pulls frame 160 and front housing member 18 rearwardly toward rear housing member 12. Thereby, the circumferential peripheries of feed rolls 68 and 70 are urged together.

When it is desired to pivot front housing member 18 away from rear housing member 12, as shown in broken lines in FIG. 1, handle 164 is pulled outwardly so that pins 180 disengage from openings 182, and thus frame 160 is released. For convenience, a pair of pins 186 similar to pins 180 are affixed to frame 14 and are adapted to register with openings 182 to hold handles 164 against the frame in the position shown in broken lines when front housing member 18 is pivoted away from rear housing member 12.

Figure 4:
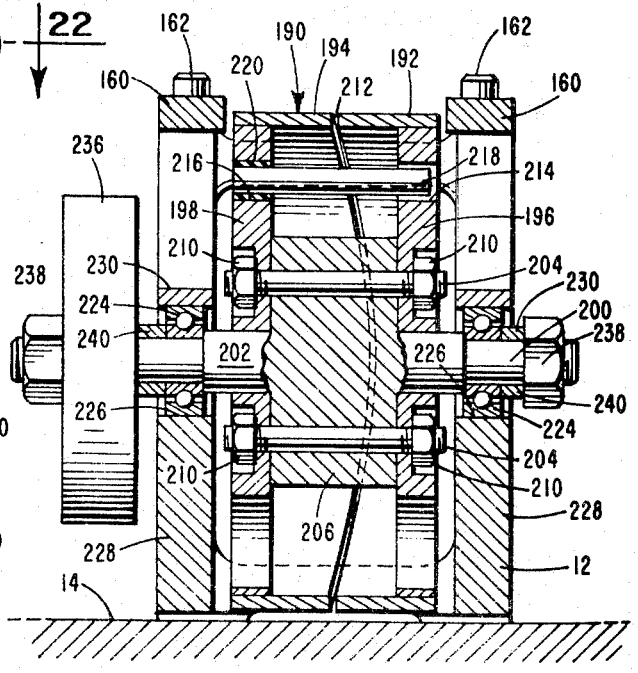
FIG. 4 is a sectional view taken on line 4—4 of FIG. 3A.

Crimper 10 further includes means mounted below feed rolls 68 and 70 for feeding yarn to the nip between the feed rolls. The yarn feeding means includes a split cam 190 (FIGS. 3A and 4). Cam 190 comprises a pair of axially opposed, cylindrical yarn guiding members 192 and 194 which are affixed, respectively, to a pair of circular flanges 196 and 198. Flanges 196 and 198 are mounted on a shaft 200 having an enlarged cylindrical central portion 202. Flanges 196 and 198 accommodate the ends of the enlarged portion 202, and are connected together by a plurality of circumferentially spaced bolts 204 passing through a hub 206. The ends of bolts 204 are threaded and receive nuts 210 thereon which lock flanges 196 and 198 onto shaft 202. Yarn guiding members 192 and 194 define a helical slot 212 (FIG. 4) therebetween through which yarn is fed to feed rolls 68 and 70 as described below. Flanges 196 and 198 are provided with a plurality of opposed openings 214 and 216 which accommodate a plurality of yarn support rods 218, which are cemented in place at one end with resilient cement 220 set in openings 216. This allows relatively easy replacement of rods 218, which are subject to wear, as well as some flexibility to loading. Yarn support rods 218 limit the depth to which the yarn penetrates helical slot 212.

Shaft 200 is journalled about an axis parallel to the axes of feed rolls 68 and 70 in bearings 224, which are accommodated in recesses 226 in a pair of arms 228 integral with frame 12. Bearings 224 are locked in position by retainers 230 which are secured to arms 228 by bolts 232. Also mounted on shaft 200 is a pulley 236. A pair of nuts 238 are threaded onto the ends of shaft 200, and spacers 240 are interposed between bearings 224, pulley 236 and nuts 238.

A pair of pulleys 242 and 244 (FIG. 1) are mounted on a shaft 246 which is journalled about an axis parallel to the axes of feed rolls 68 and 70 in bushings 248. Bushings 248 are accommodated in a pair of arms 250 (only one of which is shown) affixed to frame 14, and are locked in position by retainers 252 which are secured to arms 250 by bolts 254. Another pulley 256 is mounted on a shaft 258 attached to rear stationary housing 12.

A first belt 260 is trained about pulleys 114, 242 and 256. The back side of belt 260 also engages pulley 236. Thereby, yarn feed rolls 68 and 70 are driven in synchronism with yarn traverse cam 190. A second belt 262 is trained about pulley 244 and another pulley (not shown) connected to an appropriate driving means (also not shown), such as an electric motor, for driving feed rolls 68 and 70 and cam 190.

A third belt 264 is trained about pulley 146 and still another pulley 266 which is attached to the output shaft of a transmission 268. An electric motor (not shown) is drivingly connected to transmission 268 for rotating crimp control rolls 122 and 124 independently of feed rolls 68 and 70. Appropriate openings are provided in frame 14 to permit the passage of cable 166 and belts 260 and 264 therethrough.

Crimper 10 further includes a cooling tower 270 (FIGS. 1, 2, 3B and 17) affixed to the upper end of crimping chamber 26. Bars 32 extend through the entire cooling tower 270. Tower 270 comprises a rear member 272 and a front member 274. Front member 274 is formed of sheet material and has a U-shaped cross-section that encompasses bars 32. Members 272 and 274 are longitudinally mated and together define a channel 278 that is a continuation of channel 36. Members 272 and 274 are connected together by bolts 280, which also pass through openings in bars 32, thus attaching cooling tower 270 to the top of crimping chamber 26. Several longitudinally extending traverse openings 282 are formed in the side of member 274 to permit a coolant, such as compressed air, to contact the yarn. A yarn exit guide 286 is mounted on a flange 288 formed as a part of member 274. Members 272 and 274 are spaced slightly from the top of chamber 26 by an air gap 289, to preclude transfer of heat from chambers 26 to the cooling tower.

A slug 300 (FIG. 19) rides freely in the upper end of channel 278 on the top of the core of crimped yarn contained therein. Slug 300 has an upper parallelepiped shaped portion 302 and a lower generally pyramidal shaped portion 304. Lower portion 304 includes a pair of leg-like members 306 and 308 which extend downwardly and outwardly at opposite sides thereof. A channel 310 having a generally rectangularly shaped transverse cross-section extends longitudinally through slug 300. A small permanent magnet 312 is mounted in a transverse groove 314 formed in one side of upper portion 302, for the purpose of operating a set of crimper control switches, described below. Slug 300 is guided in its vertical movements by bars 32. Since the upper parallelepiped shaped portion 302 is smaller than the lower portion 304, the slug can rock slightly so that legs 306 and 308 always contact yarn core 510.

A printed circuit board 320 is mounted on the side of member 272 adjacent the upper end thereof. A plurality of bolts 322 extend through board 302 and are threaded into member 272. Mounted on board 320 are five vertically spaced, magnetically sensitive switches 328, 330, 332, 334 and 336.

Member 272 has a longitudinally extending transverse recess 340 to accommodate switches 328–336. As slug 300 moves vertically upwardly and downwardly with the upper end of the core of crimped yarn, magnet 312 moves into and out of proximity with switches 328–336, and selectively closes and opens the switches. Electrical leads 340, 342, 344, 346 and 348 connect switches 326, 328, 330, 332, 334 and 336 respectively, to various electrical circuits to control the operation of crimper 10, as described below.

In addition to the means for alignment of crimping chamber 26 upon installation on rear stationary member 12, means are also provided for precise alignment of feed rolls 68 and 70 with respect to one another. Feed roll 68 is mounted on rear stationary member 12, while feed roll 70 is mounted on front housing 18, which is pivotally attached to rear stationary housing 12 by an eccentric mounting structure broadly designated by the numeral 20. This structure is shown in detail in FIGS. 24–27. Rear housing 12 is provided with a pair of spaced outwardly extending mounting ears 350 and 352, having bores 354 and 356, respectively. A slit 358 extends outwardly from each of the bores 354 and 356, and clamping screws 360 extend through openings 362 into threaded holes 364.

Figure 26:
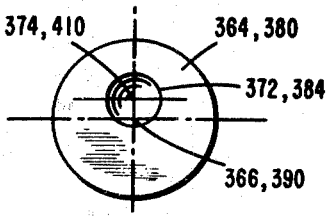
FIG. 26 is a side elevational view of the pivot center of the mounting shown in FIG. 24.
Figure 27:
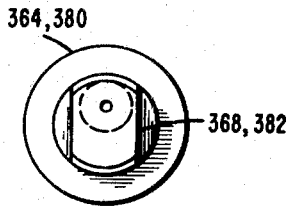
FIG. 27 is a side elevational view of the opposite side of the pivot center shown in FIG. 26.
Figure 24:
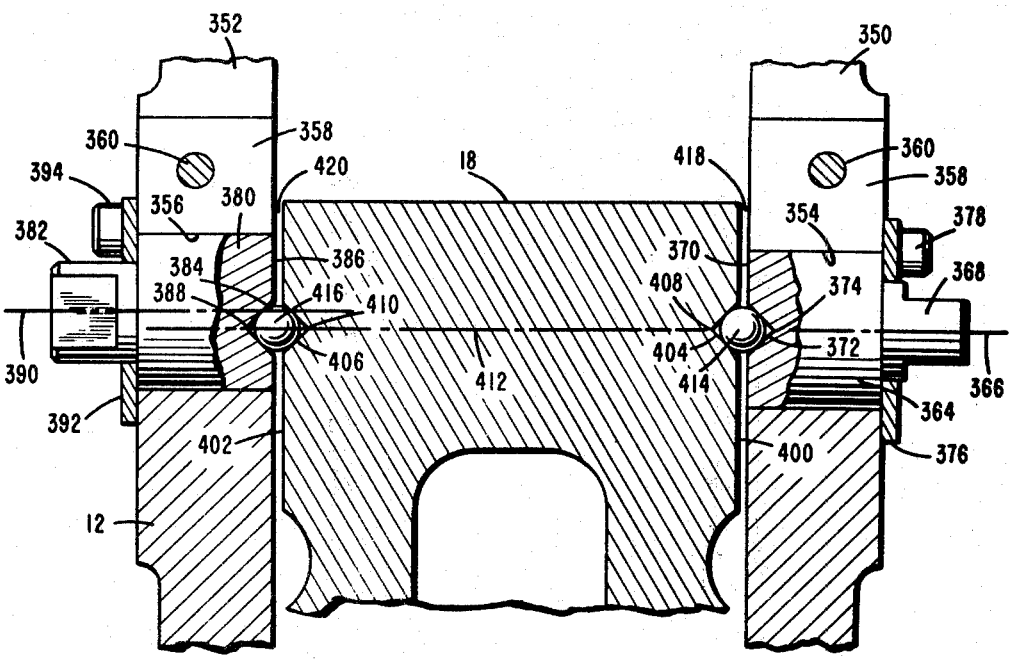
FIG. 24 is a front sectional view of the eccentric mounting means for the yoke which carries the movable feed roll of the apparatus shown in FIG. 1, taken along the line 24—24 of FIG. 25.
Figure 30:
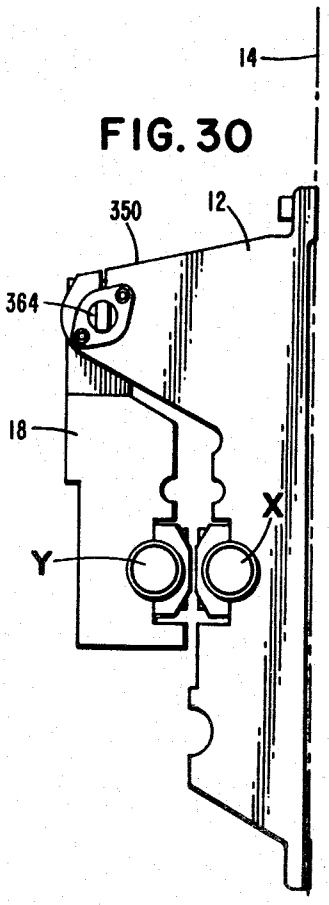
FIGS. 28, 29 and 30 are top, front and side views, respectively, of feed roll alignment test set-up.

A pivot center 364 in the form of a cylindrical plug is accommodated in bore 354. Attached to the outer surface of pivot center 364, on the center axis 366 thereof, is an adjustment lug 368, which can be engaged by a wrench or the like to rotate pivot center 364. On its inner surface 370, pivot center 364 is provided with a cone-shaped recess 372, the apex 374 of which is located offset from center axis 366, as shown in FIGS. 26 and 27. A cover plate 376 attached to arm 350 by screws 378 holds pivot center 364 against outward movement.

Likewise, a second pivot center 380 is installed in bore 356. An adjustment lug 382 is attached to the outside of pivot center, and a cone-shaped recess 384 is provided on inside surface 386. The apex 388 of recess 384 is offset from center axis 390 of pivot center 380. A pivot center cover 392 is attached to arm 352 by screws 394 to hold pivot center 380 against outward movement.

The upper portion of front housing member 18 is provided on its sides 400 and 402 with a pair of cone-shaped recesses 404 and 406, the apexes 408 and 410 of which are aligned on a pivot axis 412. A pair of hard metal balls 414 and 416 are interposed between front housing member 18 and arms 360 and 352, seated in recesses 372 and 404, and 384 and 406, respectively. Balls 414 and 416 are tightly seated in the cone-shaped recesses. The diameters of the balls are selected to provide gaps 418 and 420 between front housing member 18 and arms 350 and 352.

Figure 28:
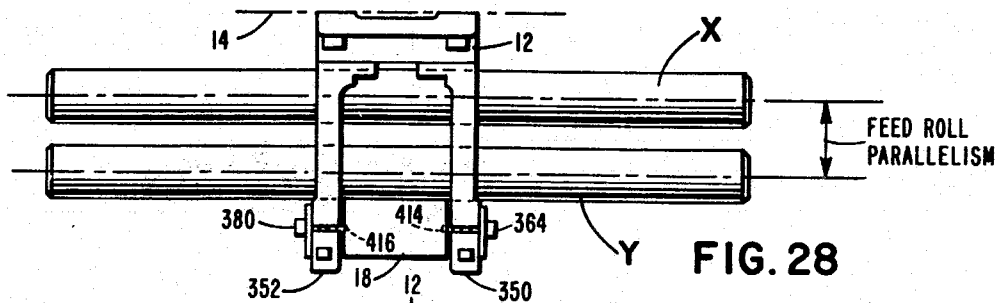
Figure 29:
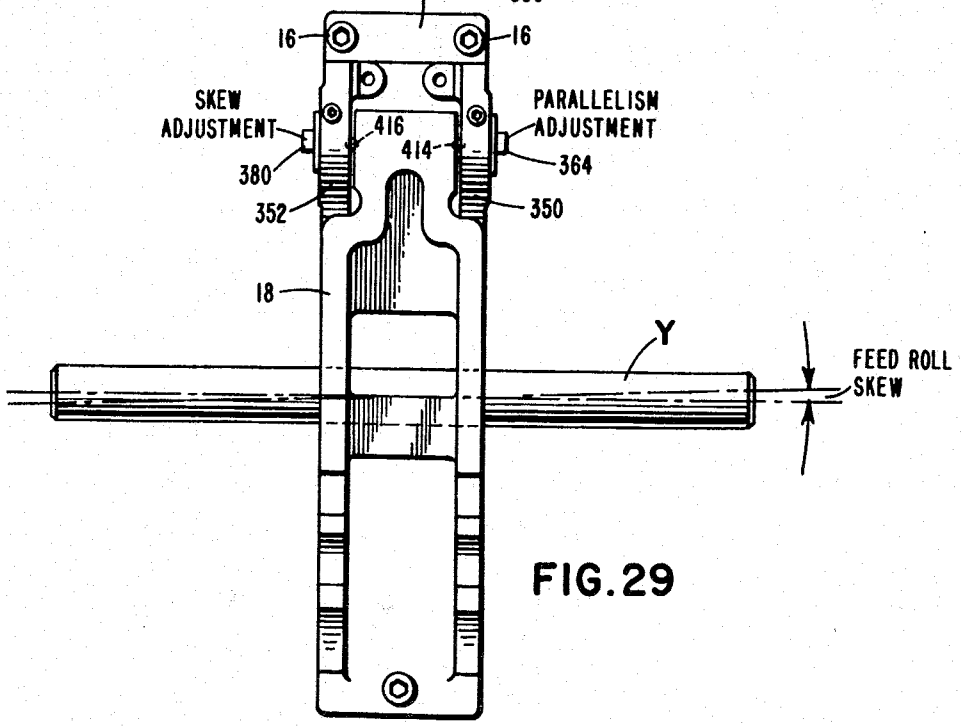

Two degrees of alignment are necessary between feed rolls 68 and 70. Shown in FIGS. 28 and 29 is a test set-up to accomplish this. A pair of elongated test fixtures X and Y are installed on the crimper in place of the feed rolls, to accentuate any misalignment. For purposes of explanation, pivot center 364 has been designated the feed roll parallelism adjustment, and pivot center 380 the feed roll skew adjustment. If it is found, upon placing front housing member 18 in the operating position, that the surfaces of test fixtures X and Y are not parallel to one another in vertical planes, that is, looking down from the top, pivot center 364 is rotated, and thus offset ball 414 describes an arcuate movement. This causes the upper portion of front housing member 18 to move about the fixed ball 416 and results in compound arcuate movement by the lower portion of housing member 18 and, of course, of test fixture Y. By suitable manipulation, the feed roll parallelism is established. Likewise, if one test fixture is skewed with respect to the other, that is, not parallel along the bite when looking from the front of the crimper, pivot center 380 is rotated. This causes offset ball 416 to describe an arc, and front housing member 18 to move about stationary ball 414. In actual practice, the combination of the two eccentrically mounted balls allows precise adjustment of the feed rolls necessary for the proper operation of the stuffer crimper. Once alignment is completed, bolts 360 are tightened to clamp pivot centers 364 and 380 securely in this adjusted position. Test fixtures are then removed, and feed rolls 68 and 70 installed.

Figure 11:
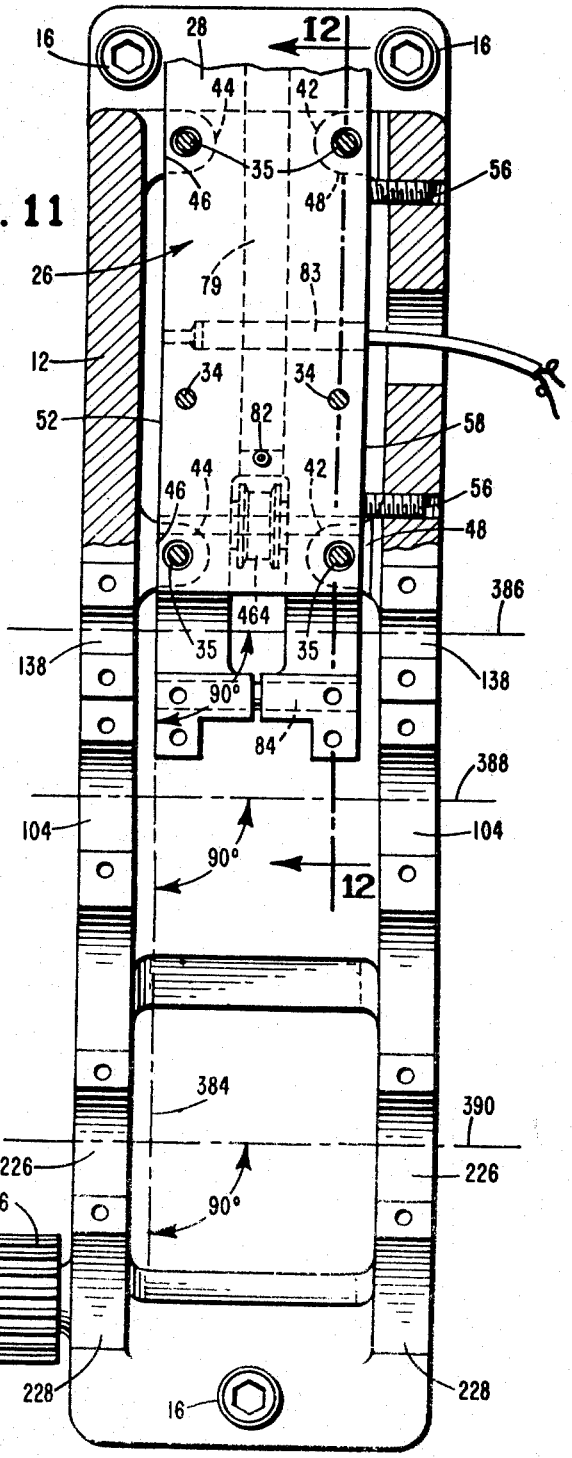
FIG. 11 is a front elevation view partially in section of the lower portion of the apparatus shown in FIG. 1, with some elements removed for clarity.

In order for the crimper 10 properly to operate, the axes of the various roll shafts must accurately be aligned with the longitudinal axis of channel 38, to which the side surface 50 and rear surface 52 of chamber 26 are aligned. Rear alignment surfaces 44 and 48 of bosses 40 and 42 and side alignment surfaces 46 of bosses 40 are accurately machined so that crimping chamber 26 is properly positioned. A longitudinal alignment axis 384 is established through side alignment surfaces 46, and the various bearing recesses, the bearings themselves, and the shafts mounted in the bearings, are oriented to the axis 384 (FIG. 11). Crimp control roll axis 386, feed roll axis 388, and traverse cam axis 390 are perpendicular to alignment axis 384. Crimping chamber 26 is automatically aligned when it is installed, since it abuts side alignment surfaces 46.

As explained above, prior art crimpers have experienced considerable difficulties in moving the core of crimped yarn through chamber 36 to the cooling tower 270. To overcome these problems, the crimper of this invention is provided with a novel yarn core transport mechanism. A driven endless belt 400 engages the mass (or core) of crimped yarn to positively transport it through the setting chamber into the cooling tower. Transport belt 400 is uniquely interrelated with crimp control rolls 122 and 124, and together they insure that the mass of crimped yarn is of proper density, and that this density is maintained uniform as the yarn moves through the setting process. The transport belt moves the yarn core at the desired speed. Transport belt 400 can be in the form of reinforced fabric material, metal tape, rubber or the like. It is the function of transport belt 400 positively to engage the mass of crimped yarn, and therefore a plurality of spaced engaging elements are provided. In the case of a fabric belt, this can be in the form of upstanding gripping elements or pins 402 woven into or secured to belt 400 (FIG. 15), or a plurality of spaced upstanding silicone rubber teeth 404 (FIG. 16).

Belt 400 passes around belt pulley portion 154 of crimp control roll 124, and then passes upwardly through channel 36 and through the lower portion of channel 278. The back surface of belt 400 contacts the chamber liner 33. Belt 400 then travels around an adjustable idler pulley 414 mounted on a bearing 416, which is in turn supported on a shaft 418. Shaft 418 has a head portion 420 and a threaded portion 422 that is screwed into an idler arm 424. Idler arm 424 is pivotally supported by a rod 430 mounted in openings 432 in rear cooling tower element 272. Rod 430 has a peripheral groove 434 at one end, which is engaged by a locking screw 436 in rear tower element 272. A spacer 438 separates idler arm 424 from member 272. Idler arm 424 is mounted in such a position as to place the outer surface of idler pulley 414 at an opening 440 in the rear wall of chamber 278, spaced slightly outwardly of the said rear wall to receive belt 400.

Pivotable idler arm 424 provides the means for adjusting the tension on belt 400. A shoulder 442 extends inwardly from rear tower member 272 beneath idler arm 424. A threaded plug 444 is screwed into a threaded opening in shoulder 442 and secured with a lock nut 445. Plug 444 is provided with an axial bore having an internally threaded portion 446, a smooth-walled middle portion 448 and a smooth-walled end portion 450 of lesser diameter than portion 448. A pin 452 having a rounded end 454 and a flanged portion 456 is received in bore portions 448 and 450, with head 454 protruding from plug 444. A helical coil spring 458 is contained in middle portion 448. An adjustment screw 460 is screwed into threaded portion 446, and bears against one end of spring 458, the other end of which bears against pin 452. The rounded head 454 contacts the underside of idler arm 424 (FIG. 22) and urges idler arm 424 upwardly to tension belt 400 in accordance with the pressure placed on spring 458 by screw 460.

Finally, belt 400 proceeds downwardly to another idler pulley 464 mounted on a bearing 466 supported by a shaft 468 mounted in a slot 469 in the rear bottom end of chamber member 30. A belt cover 470 it attached to the rear of chamber member 30 by screws 472, as shown in FIG. 14.

Figure 31:
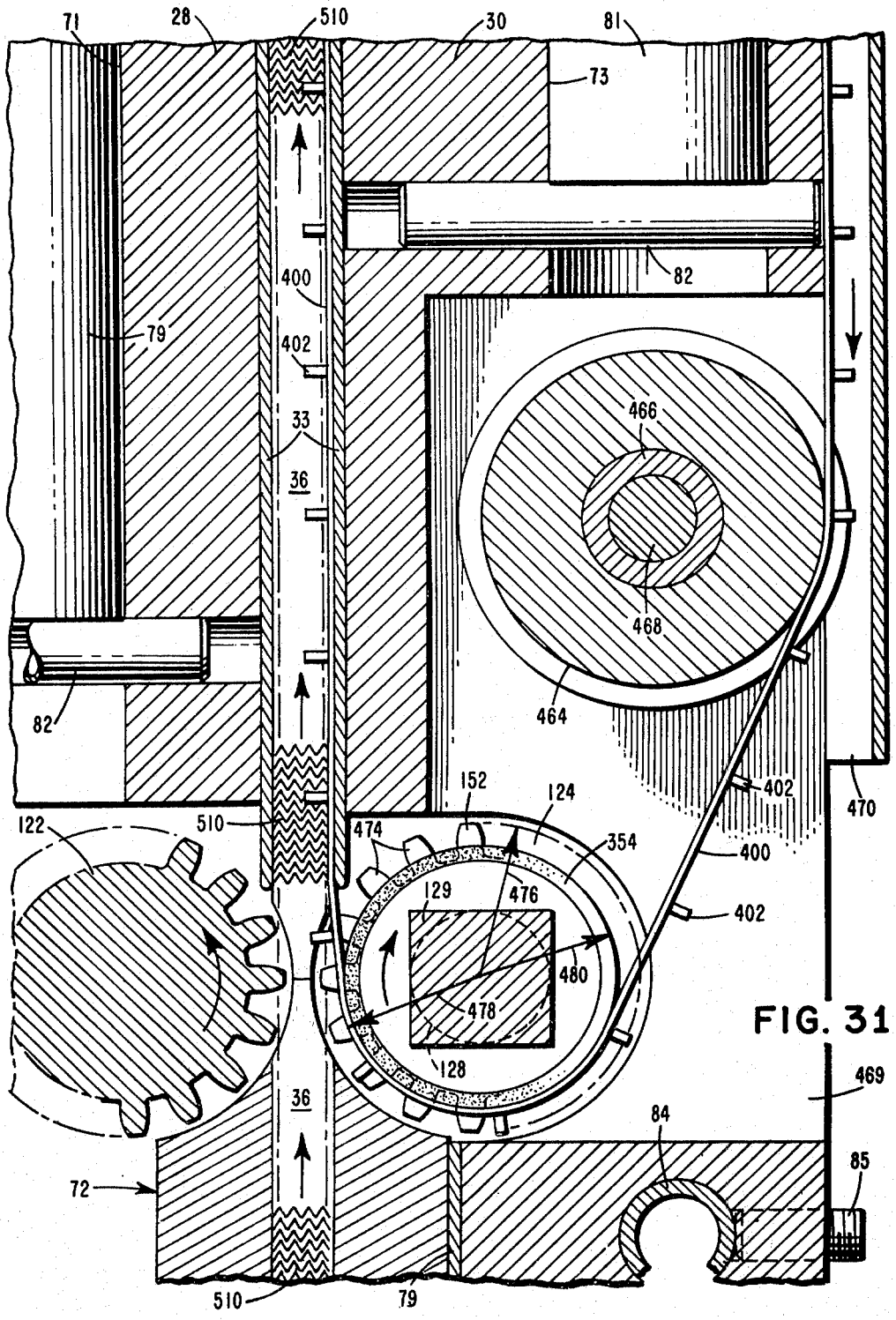
FIG. 31 is a sectional view of the crimp control rolls and a portion of the yarn transport belt of the apparatus shown in FIG. 1.

There is a particularly critical relationship between belt 400 and crimp control roll 124. The function of crimp control rolls 122 and 124 is to feed the crimped yarn at a controlled rate from the crimping zone beneath the crimp control rolls to the setting zone above the crimp control rolls. It is important that the characteristics of the core of crimped yarn, such as the density and homogeneity, be maintained constant throughout the yarn setting operation, or else the crimp characteristics can be disturbed, which results in an imperfect yarn. The yarn core enters the setting zone at a particular linear speed, imparted by the crimp control rolls, as applied to the yarn core at a particular point on the teeth which can be labeled the effective diameter. Since the teeth embed themselves into the yarn core, the effective diameter is measured at a point on the teeth short of the tips, and is thus somewhat less than the full outside diameter of the teeth. The linear speed of the yarn transport belt is matched to the linear speed of the gear at the point of the effective diameter. Looking to FIG. 31, it is seen that teeth 474 subscribe a radius 476. However, the effective linear speed imparted by the gears is measured at a lesser radius 478. The radius 480 of belt pulley 154 is selected so that the speed of the transport belt matches the effective peripheral speed of the crimp control rolls. Thereby, there is no change in the speed of movement of the yarn core as it passes from the influence of the crimp control rolls to that of the transport belt. It has been found to be advantageous to have the length of pins 402 slightly greater than the length of the crimp control roll teeth.

Alternatively crimp control roll 124 could be devoid of teeth, functioning only as a pulley for a somewhat wider belt. Then, the belt could also function as the second of the pair of crimp control rolls.

The method of the invention will now be described in detail with reference to crimper 10. Continuous filament yarn 500 is fed from a spool of such yarn or other source of yarn supply through a conventional tension control mechanism 502 (FIG. 1) upwardly into slot 212 of cam 190. Slot 212 guides the yarn into the nip between feed rolls 68 and 70 with a traversing movement back and forth axially of the feed rolls. As the yarn passes through cam 190, it contacts rod 218. Rods 218 and the edges of cam portions 192 and 194 which define slot 212 are polished so that friction is minimized. In order to obtain uniform feeding of the yarn into the nip, both with respect to yarn quantity and orientation, it is necessary that tension of a controlled magnitude be applied to the yarn between mechanism 502 and feed rolls 68 and 70.

A conventional preheater 504 may be interposed between mechanism 502 and cam 190 to preheat yarn 500 prior to the crimping thereof. Generally, it has been found desirable to preheat yarn which is heavier than two denier per filament. Preheating softens the yarn and facilitates the crimping thereof.

Immediately after passage between feed rolls 68 and 70, the yarn is fed against a mass of crimped yarn in the form of a core of crimped yarn 510 (FIG. 3A) in the lower end of channel 36, causing the yarn to collapse longitudinally and fold over, forming crimps which become part of the core. The generally elliptical transverse cross-sectional configuration of the lower portion of channel 36 minimizes voids in the channel in the zone immediately above the feed rolls so that a substantially uniform crimping pressure will be applied to the yarn after it passes between the feed rolls. The portion of channel 36 between feed rolls 68 and 70 and crimp control rolls 122 and 124 comprises a crimping zone. The crimp control rolls effectively isolate the crimping zone from the portion of channel 36 thereabove. By controlling the relative rotational velocities of the feed rolls and the crimp control rolls, the back pressure or crimping force exerted on the yarn in the crimping zone may be accurately established and controlled. Generally, for a yarn of a particular denier, an increase in the crimping force results in a decrease in the leg length of the crimps and an increase in the bulk of the crimped yarn. The crimping force may be increased by decreasing the rotational velocity of crimp control rolls 122 and 124 with respect to the rotational velocity of feed rolls 68 and 70. The yarn is crimped and plastically deformed in the crimping zone. However, the heat and pressure applied to core 510 and the time of residence of the core in the crimping zone is insufficient to cause the yarn to be set permanently, and in the absence of pressure on the core the crimps will open freely after passage through the crimping zone. Moreover, for polyester yarn, it is desirable that the residence time of the yarn in the crimping zone be relatively short to minimize the effects of friction on the formation of the crimps, and therefore, the distance between feed rolls 68 and 70 and crimp control rolls 122 and 124 along channel 36 is relatively short. This arrangement facilitates accurate control of the conditions within the crimping zone, with the frictional forces exerted on the yarn by the walls of channel 36 in the crimping zone having little or no effect on such conditions.

Also, desirably the cross-sectional dimension of channel 36 in the direction perpendicular to the axes of feed rolls 68 and 70, i.e. the cross-sectional width of the channel, should be as small as possible to promote uniform heat transfer from chamber 26 to and through core 510. Ideally, the cross-sectional width of channel 36 should be approximately equal to the diameter of yarn 500. However, at least two factors limit the minimum cross-sectional width of the channel. First, as the cross-sectional width of the channel is decreased, the angle defined between each of the side walls of the channel which extend in the direction parallel to the feed roll axes and respective arcuate surfaces 74 and 76 also is decreased (FIG. 3A). If such angle is made too small, the adjacent portion of saddle 72 does not possess sufficient strength to withstand the pressure exerted thereagainst by core 510 without deforming or fracturing. Second, as such angle is decreased, the apex thereof necessarily is moved downwardly closer to the nip between feed rolls 68 and 70. If the apex of the angle is moved too close to the nip between the feed rolls, as yarn 500 is fed through the nip, the yarn will tend to move under surfaces 74 and 76 between such surfaces and feed rolls 68 and 70 rather than into channel 36, regardless of the presence of felt pads 82, whose purpose is to prevent yarn 500 from moving out of the crimper between feed rolls 68 and 70 and arcuate surfaces 74 and 76. This is particularly necessary during start-up of the crimper, before core 510 fills the crimping zone.

It has also been found that the cross-sectional width of channel 36 in relation to the cross-sectional area of yarn 500 has an important effect on the operation of the crimper. For example, for wearing apparel yarn, i.e., 40–150 denier, the ratio of cross-sectional width of the channel in inches to the yarn denier should be in the range from about 0.000667 to about 0.00425; the cross-sectional area of the yarn being proportional to the denier thereof. Preferably, such ratio is in the range of from about 0.001 to about 0.004. If the cross-sectional width of channel 36 is reduced below an amount required to satisfy the above-mentioned range of values for such ratio, the yarn will tend to move under surfaces 74 and 76 between such surfaces and feed rolls 68 and 70. For yarn having a denier in the range of 40–150, the cross-sectional width of the channel should be in the range of from about 0.10 inch to about 0.17 inch, and preferably is about 0.16 inch.

Crimp control rolls 122 and 124 engage and feed core 510 upwardly out of the crimping zone to the setting zone, which extends between crimp control rolls 122 and 124 and the upper end of chamber 26. In the setting zone, the core is subjected to heat and pressure sufficient only to keep the crimps that were formed in the crimping zone closed. The only pressure exerted on the core in the setting zone is the weight of the core itself and the relatively light weight of slug 300 which rides on the upper end thereof. In the setting zone, the yarn is fully set.

The heat and pressure to which the yarn is subjected in the crimping zone, and the heat of the setting zone, cause deposits to form on the walls of channel 36 in the setting zone. These deposits are often emulsions formed from the lubricating oil present in the yarn. The deposits are of gum-like consistancy, and scrape against the outer surface of yarn core 510, causing physical damage to the yarn, a tear-drop effect on yarn core movement, and uncontrollable and varying back pressures upon the yarn core. The result is a yarn having unpredictable and undesirable crimp characteristics, as well as physical damage. In some cases, the retardation of the movement of the yarn core is so severe that the moving yarn core is turned into a stationary wad of yarn, that jams the machine.

The use of low friction inserts 33 in channel 36 somewhat reduces the problem of deposits, but not to acceptable levels. However, yarn transport belt 400 does solve the problem. It positively engages yarn core 510 at the point at which it passes from the influence of crimp control rolls 122 and 124. Belt 400 positively grips the core 510, by means of pins 402. It moves the core through the setting zone and into the cooling tower 270 at the same linear speed imparted by the crimp control rolls. THis overcomes the increased resistance to movement caused by the deposits, and in fact tends to clean the channel walls. The yarn core does not slow down or move jerkily, and uniform density is maintained because the core is engaged by the belt along its entire length.

After passing through the setting zone, core 510 is transported into channel 278 of cooling tower 270, at which time the yarn is cooled below the temperature at which it undergoes any molecular structural alteration in the absence of the application of a substantial force thereto. If desired, and depending upon the necessity therefore, a coolant, such as compressed air, may be introduced into and circulated through the core through openings 282. The crimped yarn is withdrawn from channel 278 through channel 310 through slug 300 in continuous filament form by a conventional winder 512 on which it is wound into cones for further processing, as desired.

Figure 19:
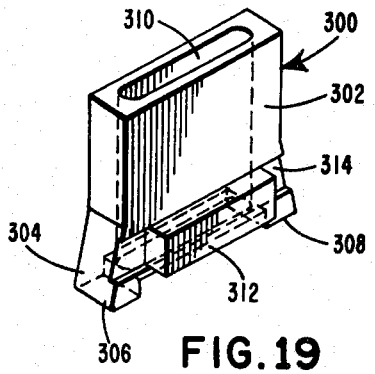
FIG. 19 is a perspective view of the slug employed in the apparatus shown in FIG. 1.
Figure 25:
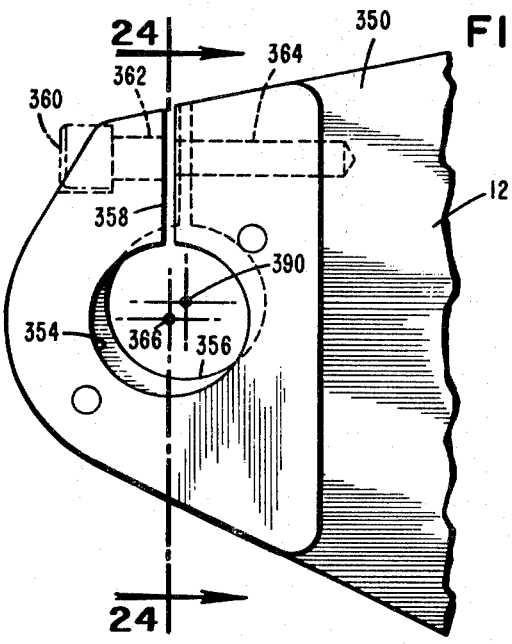
FIG. 25 is a side elevational view of a portion of the mounting shown in FIG. 24.

The external configuration and dimensions of slug 300 are important to smooth, substantially slub-free withdrawal of the yarn from cooling tower 270. The only portions of the slug which contact the upper end of core 510 are leg-like members 306 and 308 (FIG. 19). The portions of the core contacted by members 306 and 308 are positioned adjacent the short cross-sectional transverse dimension of channel 278 and are the portions in which the yarn feed direction, axially of the feed rolls, is reversed by cam 190. Members 306 and 308 apply a slight pressure, namely the weight of slug 300, on such portions and thereby require that a relatively small increase in tension be applied to the yarn to pull it out from under the members. The application of this increased tension pulls substantially all of the tangles out of the yarn and thereby minimizes the occurance of slubs. The central section of the lower portion of slug 300 does not contact core 510 so that there is no impedance to the withdrawal of yarn from the central portion of the core. The long external, transverse cross-sectional dimension of both the upper portion and the lower portion of slug 300 is less than the long transverse cross-sectional dimension of channel 278 so that slug 300 can rock back and forth slightly on members 306 and 308 to accommodate slight differences in the height of the end portions of the core.

As the yarn is withdrawn from tower 270, the upper end of core 510, and therefore slug 300, move vertically upwardly and downwardly as determined by the rate at which the yarn is withdrawn in relation to the rate of upward movement of te core. Magnet 312 and switches 328, 330, 332, 334 and 336 cooperate to control the height of the core.

Switches 328, 330 and 336 are safety limit switches. If the height of yarn core 510 increases to the point where magnet 312 moves into proximity with switch 330, the switch closes, and the driving means are deactivated for cam 190, feed rolls 68 and 70, and crimp control rolls 122 and 124 so that no more yarn is fed into the device. If the height of the yarn core decreases so that magnet 300 moves into proximity with switch 336 closing such switch, the driving means for both the yarn feed devices and yarn winder 330 are deactivated. These are both abnormal conditions and occur only under such circumstances as when the yarn breaks between the crimper and winder, or between the source of yarn supply and feed rolls 38 and 40. Switch 328 is an auxiliary safety cut-off switch which keeps the crimpers from being operated if the magnet moves above switch 330.

During normal operating conditions, magnet 312 moves vertically upwardly and downwardly between switches 332 and 334; both of which are operably connected to the winder driving means. When magnet 224 moves into proximity with switch 332, closing such switch, winder 512 is driven at 100% of a predetermined speed. This predetermined speed is slightly greater than the speed required to withdraw the yarn from tower 270 at the same rate at which it is fed into the tower. Therefore, the upper end of core 152 and slug 300 will gradually move downwardly until magnet 312 moves into proximity with switch 334, closing switch 334. When switch 334 is closed, the winder is driven at a speed less than the aforementioned predetermined speed, for example, at 80% of the predetermined speed. At such lower speed the winder withdraws yarn at a rate which is less than that at which it is fed into tower 270. In this manner, the upper end of the core and the slug move upwardly and downwardly continuously a distance approximately equal to the distance between switches 332 and 334, thus maintaining the upper end of the core within a predetermined range.

While the foregoing constitutes a detailed description of a preferred embodiment of the method and apparatus of the invention, it is recognized that modifications thereof will occur to those skilled in the art. Accordingly, the scope of the invention is to be limited solely by the scope of the appended claims.

We claim:

1. A stuffer crimper for crimping continuous filament yarn comprising:

a housing, a crimping chamber secured to said housing and having a channel extending therethrough, said crimping chamber defining crimping and setting zones disposed successivly along the length of said chamber, a pair of opposed feed rolls rotatably mounted on said housing adjacent one end of said chamber for feeding yarn into said chamber against a mass of crimped yarn therein causing said yarn to fold over upon itself to form crimps and then become part of the mass of crimped yarn, means for driving said feed rolls at a first rotational velocity.

a pair of crimp control rolls rotatably mounted on said housing in opposed relationship to one another and extending into said channel at the juncture of said crimping zone and said setting zone, the peripheral surfaces of said crimp control rolls defining a yarn passage of fixed width therebetween and having core gripping surfacing to positively engage the crimped yarn mass in said yarn passage, means for driving said crimp control rolls independently of said feed rolls at a constant rotational rate to move said crimped yarn mass through said yarn passage at a constant effective rate, whereby on the one hand the pressure on said crimped yarn mass in said crimping zone is controlled by regulating the relative rotational rates of the feed rolls and the crimp control rolls, and on the other hand the crimped yarn mass is moved into said setting zone at a constant effective rate regardless of changes in conditions within said crimping zone, an endless driven yarn transport belt mounted on said housing and extending across at least a portion of one wall of said setting zone for at least a portion of the length of said setting zone, said yarn transport belt having second gripping surfacing projecting into said chamber for positively engaging said crimped yarn mass and being supported at one end closely adjacent to said first gripping surfacing of one of said crimp control rolls, said yarn transport belt being substantially parallel to the opposite wall of said channel and being supported against outwardly movement caused by pressures developed within said channel, means for driving said yarn transport belt at a constant rate so related to the rate of said crimp control rolls as to move said crimped yarn mass at said fixed effective rate applied initially by said crimp control rolls.

2. A stuffer crimper according to claim 1 wherein said one of said crimp control rolls comprises a pulley portion and at least one gripping portion equipped with said first gripping surfacing, and wherein said yarn transport belt passes around said pulley portion, the diameter of said pulley portion being so related to the diameter of said gripping portion as to cause both said gripping portion and said yarn transport belt to move said crimped yarn mass at substantially identical rates.

3. A stuffer crimper according to claim 2 wherein said setting zone comprises a heating zone and a cooling zone, and said yarn transport belt extends through the entire setting zone and at least a portion of the cooling zone.

4. A stuffer crimper according to claim 2 wherein said crimp control rolls and said yarn transport belt extend across substantially the entire width of said chamber.

5. A stuffer crimper according to claim 1 further comprising friction reducing means backing said belt in said chamber to support said belt against the outward pressure of said crimped yarn mass.

6. A stuffer crimper according to claim 1 further comprising a belt idler roll spaced from said crimp control roll and defining one end of the path of said belt, said belt passing around said idler roll, and idler roller mounting means including means biasing said idler roll to tension said belt.

7. A stuffer crimper according to claim 6 wherein said means biasing said idler roll comprises an idler roll shaft upon which said idler roll is rotatably mounted, a movable arm carrying said idler roll shaft, spring means bearing against said movable arm to urge said idler roll to tension said belt, and means for adjusting the force applied by said spring means to said arm.

8. A stuffer crimper according to claim 1 wherein said crimp control rolls are spaced from said feed rolls along said channel a distance no greater than the distance required for the yarn to be plastically deformed and partially set in said crimping zone.

9. A stuffer crimper according to claim 1 wherein the axis of said crimp control rolls are parallel to the axes of said feed rolls.

10. A stuffer crimper according to claim 1 wherein said chamber channel has a substantially rectangular transverse cross-section, and wherein said yarn transport means extends along the side of said channel having the longest cross-sectional dimension.

11. The stuffer crimper according to claim 1 further comprising yarn winding means for extracting the crimped yarn from said cooling zone, and means sensing the level of said crimped yarn mass in said cooling zone to control the rate of extraction of said yarn winding means.

12. A stuffer crimper according to claim 11 wherein said means sensing the level of said crimped yarn mass comprises a sensor positioned on the crimped yarn mass and a plurality of electrical switches attached to said chamber at said cooling zone and operated by said sensor to control said yarn winding means.

13. A stuffer crimper for crimping continuous filament yarn comprising:

a first housing member, a crimping chamber mounted on said first housing member and having a channel extending therethrough, a first feed roll rotatably mounted on said first housing member adjacent one end of said channel, a second housing member, a second feed roll mounted on said second housing member, mounting means for pivotably attaching said second housing member to said first housing member so that said second housing member is movable about a housing pivot axis between a closed position wherein said second feed roll is adjacent said first feed roll to define a bite therebetween and an open position wherein said second feed roll is spaced materially from said first feed roll, and eccentric means for altering the orientation of said housing pivot axis to thus alter the alignment of said second feed roll with respect to said first feed roll.

14. A stuffer crimper according to claim 13 wherein said mounting means comprises first and second spaced ears on one of said housing members flanking a tongue portion of the other of said housing members, first and second pairs of opposed pivot centers, one of the pivot centers in each of said pairs being on said tongue portion defining the ends of said housing pivot axis, one of said pivot centers being rotatable about an axis of rotation and having a pivot center axis offset from said axis of rotation whereby rotation of said one pivot center causes reorientation of said pivot axis, and first and second support means engaging respectively said pairs of pivot centers at said pivot axis to support said second housing upon said pivot centers.

15. A stuffer crimper according to claim 14 wherein one of the said pivot centers of each said pair is rotatable and has a pivot axis offset from an axis of rotation.

16. A stuffer crimper according to claim 14 wherein each said pivot center comprises a pivot disc and a generally cone-shaped recess in said pivot disc coaxial with said pivot center axis, and each said support means is generally spherical.

17. A stuffer crimper according to claim 14 wherein said spaced arms are attached to said first housing member and said tongue portion is on said second housing member.

18. A stuffer crimper for crimping continuous filament yarn comprising:

a housing having at least two perpendicularly oriented reference surfaces thereon, a crimping chamber having a channel extending therethrough, said crimping chamber having first and second outside surfaces defining lines parallel to said channel, said surfaces being perpendicular to one another and contacting said reference surfaces for accurately positioning said chamber with respect to said housing along two perpendicular axes, means for securing said chamber to said housing against one of said reference surfaces, said means for securing permitting adjustment of said chamber along an axis perpendicular to said two axes, means for urging said chamber against the other of said reference surfaces, a pair of opposed feed rolls rotatably mounted on said housing adjacent on end of said chamber for feeding yarn into said chamber channel, at least one crimp control roll rotatably mounted on said housing and extending into said chamber channel, said crimp control roll being spaced from said feed rolls along said channel, the portion of said channel between the feed rolls and the crimp control roll defining a confined crimping zone, whereby continuous filament yarn is fed into said crimping zone by said feed rolls against a mass of previously crimped yarn therein causing the yarn to collapse longitudinally and fold over forming crimped yarn which becomes part of said crimped yarn mass, the portion of said channel between said crimp control roll and the end of the chamber opposite the feed rolls defining a setting zone into which the crimped yarn mass is fed by said crimp control roll, a yarn transport belt on said channel extending from said crimp control roll along said setting zone for transporting said crimped yarn mass through at least a portion of said setting zone, means for rotatably driving said feed rolls, and means for rotatably driving said crimp control roll and said yarn transport belt independently of said feed rolls.

19. A stuffer crimper as recited in claim 18 wherein said housing comprises a front member and a rear member, said front member being movably connected to said rear member, and wherein said reference surfaces are on said rear member.

* * * * *